US006047443A

United States Patent [19]

Komiyama

[11] Patent Number: 6,047,443

[45] Date of Patent: Apr. 11, 2000

[54] HAND STRAP STORAGE STRUCTURE FOR PORTABLE TERMINAL DEVICE

[75] Inventor: Takehiko Komiyama, Tokyo, Japan

[73] Assignee: NEC Corporation, Japan

[21] Appl. No.: 09/198,851

[22] Filed: Nov. 24, 1998

[30] Foreign Application Priority Data

Nov. 26, 1997 [JP] Japan ..... 9-324864

[51] Int. Cl.[7] ..... A47B 95/02

[52] U.S. Cl. ..... 16/114.1; 16/444; 16/405; 190/115; 190/116

[58] Field of Search ..... 16/114.1, 405, 16/444, 446; 190/39, 115–117

[56] References Cited

U.S. PATENT DOCUMENTS 4,890,705 1/1990 Pineda ..... 190/115
4,928,800 5/1990 Green et al. ..... 190/115
5,653,319 8/1997 Wang ..... 190/115
5,845,978 12/1998 Jung ..... 16/405

FOREIGN PATENT DOCUMENTS 7273686 10/1995 Japan .
8010030 1/1996 Japan .

*Primary Examiner*—Anthony Knight
*Assistant Examiner*—Mark Williams
*Attorney, Agent, or Firm*—Ostrolenk, Faber, Gerb & Soffen, LLP

[57] ABSTRACT

A first caulking portion and a second caulking portion are provided to a hand strap to be separate from each other. A plurality of recesses are formed in two side surfaces of each of the first and second caulking portions. A plurality of projections are formed on two side wall surfaces of a hand strap storage portion to respectively engage with the plurality of recesses. A folded end portion fixing mechanism is formed on the first caulking portion to detachably fix a folded end portion formed on a proximal end of a thick string loop when storing the hand strap.

17 Claims, 8 Drawing Sheets

HAND STRAP STORAGE STRUCTURE FOR PORTABLE TERMINAL DEVICE

BACKGROUND OF THE INVENTION

1. Field of the Invention

The present invention relates to a hand strap storage structure for a portable terminal device and, more particularly, to a hand strap storage structure for a cellular telephone.

2. Description of the Prior Art

Conventionally, as a means for allowing the user to carry a portable terminal device such as a compact electronic equipment and a cellular telephone, a hand strap structure or a hand strap storage structure disclosed in, e.g., Japanese Unexamined Patent Publication Nos. 7-273686 and 8-10030 is used.

FIG. 1 is a perspective view showing the schematic arrangement of a conventional hand strap structure, and FIG. 2 is a perspective view showing the schematic arrangement of a conventional hand strap storage structure.

With the hand strap structure shown in FIG. 1, a thin string loop 4-1 of a hand strap 4 is mounted on a hand strap mounting portion 3 of a terminal device main body 1, and the user holds a thick string loop 4-2 portion with his hand or hang it from his finger or wrist, so that he can carry the portable terminal device.

In the hand strap storage structure shown in FIG. 2, a hand strap 4 portion can be stored in a hand strap storage portion 2 formed in a terminal device main body 1.

In the prior art shown in FIG. 1 described above, when the user carries the portable terminal device by using a carrying means other than the hand strap (e.g., the inner pocket of a bag or jacket), the hand strap is often caught by his finger or arm, or contents in the bag more than necessary, irritating the user.

The hand strap of the portable terminal device used by various users must have a minimum length (e.g., 200 mm). Considering this, when the prior art shown in FIG. 2 described above is employed in the recent portable terminal device which is becoming more and more compact, the length of the hand strap becomes larger than the outer size of the terminal device main body, and a hand strap storage portion cannot be formed.

In the prior art shown in FIG. 2, the hand strap stored in the hand strap storage portion is often stored by mere pressing, and cannot be reliably fixed and stored.

SUMMARY OF THE INVENTION

The present invention has been made in consideration of the above situation in the prior art, and has as its object to provide a hand strap storage structure that can easily and reliably store a hand strap and a terminal device main body having the same, so that the hand strap structure of a portable terminal device which is becoming more and more compact can be coped with.

In order to achieve the above object, according to the first major aspect of the present invention, there is provided a hand strap storage structure for storing a thick string loop of a hand strap in a terminal device main body having a hand strap mounting portion and a hand strap storage portion, the hand strap being constituted by a thin string loop and the thick string loop, and the thin string loop having a distal end engaged by the hand strap mounting portion, comprising a first caulking portion and a second caulking portion provided to the hand strap to be separate from each other, a plurality of recesses formed in two side surfaces of each of the first and second caulking portions, a plurality of projections formed on two side wall surfaces of the hand strap storage portion to respectively engage with the plurality of recesses, and folded end portion fixing means, formed on the first caulking portion, for detachably fixing a folded end portion formed on a proximal end of the thick string loop when storing the hand strap.

In order to achieve the above object, the present invention has auxiliary aspects as follows.

The first caulking portion according to the first major aspect described above is caulked to the hand strap near the hand strap storage portion of the terminal device main body.

The first caulking portion according to the first major aspect described above is caulked so as to connect a proximal end of the thin string loop and a distal end of the thick string loop of the hand strap.

The folded end portion fixing means according to he first major aspect described above is a recess formed in one end face of the first caulking portion.

The folded end portion fixing means is a recess formed to extend across two surfaces consisting of one end face and one side surface of the first caulking portion.

The recess formed in the first caulking portion and serving as the folded end portion fixing means is formed with a groove for hooking the hand strap.

The recess formed in the first caulking portion and serving as the folded end portion fixing means is formed with a stopper for preventing the hand strap from disengaging when the folded end portion of the hand strap is inserted in the recess.

A distance between the recesses formed in the two side surfaces of each of the first and second caulking portions is equal to a distance between the plurality of projections formed on the side wall surfaces of the hand strap storage portion.

In order to achieve the above object, according to the first major aspect of the present invention, there is provided a terminal device main body having a hand strap mounting portion and a hand strap storage portion and serving to engage a distal end of a thin string loop of a hand strap by the hand strap mounting portion, comprising a first caulking portion for connecting a proximal end of the thin string loop and a distal end of a thick string loop of the hand strap to each other, a second caulking portion provided on the thick string loop to be separate from the first caulking portion by a predetermined distance, a plurality of recesses formed in two side surfaces of each of the first and second caulking portions, and a plurality of projections formed on two side surfaces of the hand strap storage portion to respectively engage with the plurality of recesses, and folded end portion fixing means, formed on the first caulking portion, for detachably fixing a folded end portion formed on a proximal end of the thick string loop when storing the hand strap.

According to the hand strap storage structure of the present invention having the aspects as described above, when the hand strap is not required, it can be easily and reliably stored and fixed in the hand strap storage portion. Since the hand strap is stored by bending it into halves, the hand strap storage space can be utilized comparatively efficiently. Limitations on the outer shape of the terminal device main body which is becoming compact can be decreased.

The above and many other objects, features and advantages of the present invention will become manifest to those skilled in the art upon making reference to the following detailed description and accompanying drawings in which preferred embodiments incorporating the principles of the present invention are shown by way of illustrative examples.

BRIEF DESCRIPTION OF THE DRAWINGS

FIGS. 6A to 6C are perspective views showing an operation performed for storing the hand strap which is to be stored in the hand strap storage structure of the present invention, in which FIG. 6A shows a state wherein the hand strap is mounted on a hand strap mounting portion, FIG. 6B shows a state during folding, and FIG. 6C shows a state wherein the hand strap is stored and fixed in the hand strap storage portion;

FIGS. 7A and 7B are sectional views showing a state wherein the hand strap is stored in a terminal device main body, in which FIG. 7A is a sectional view taken along the line 7A—7A of FIG. 6C, and FIG. 7B is a sectional view taken along the line 7B—7B of FIG. 6C;

DETAILED DESCRIPTION OF THE PREFERRED EMBODIMENTS

Preferred embodiments of the present invention will be described with reference to the accompanying drawings.

Figure 1:
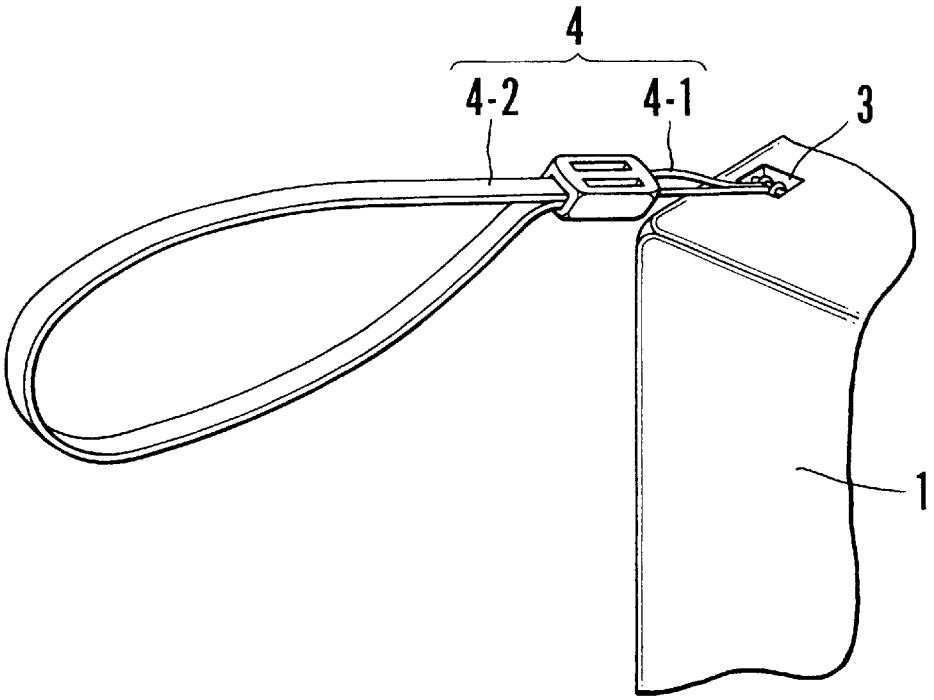
FIG. 1 PRIOR ART
FIG. 1 is a perspective view showing the schematic structure of a hand strap structure according to the first prior art.
Figure 2:
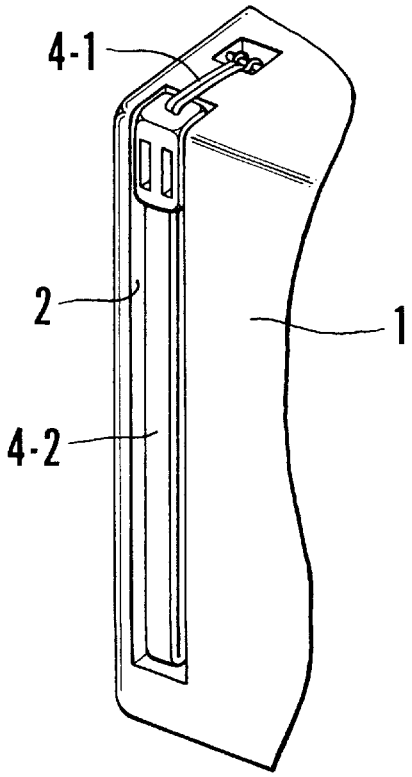
FIG. 2 PRIOR ART
FIG. 2 is a perspective view showing the schematic structure of a hand strap storage structure according to the first prior art.
Figure 3:
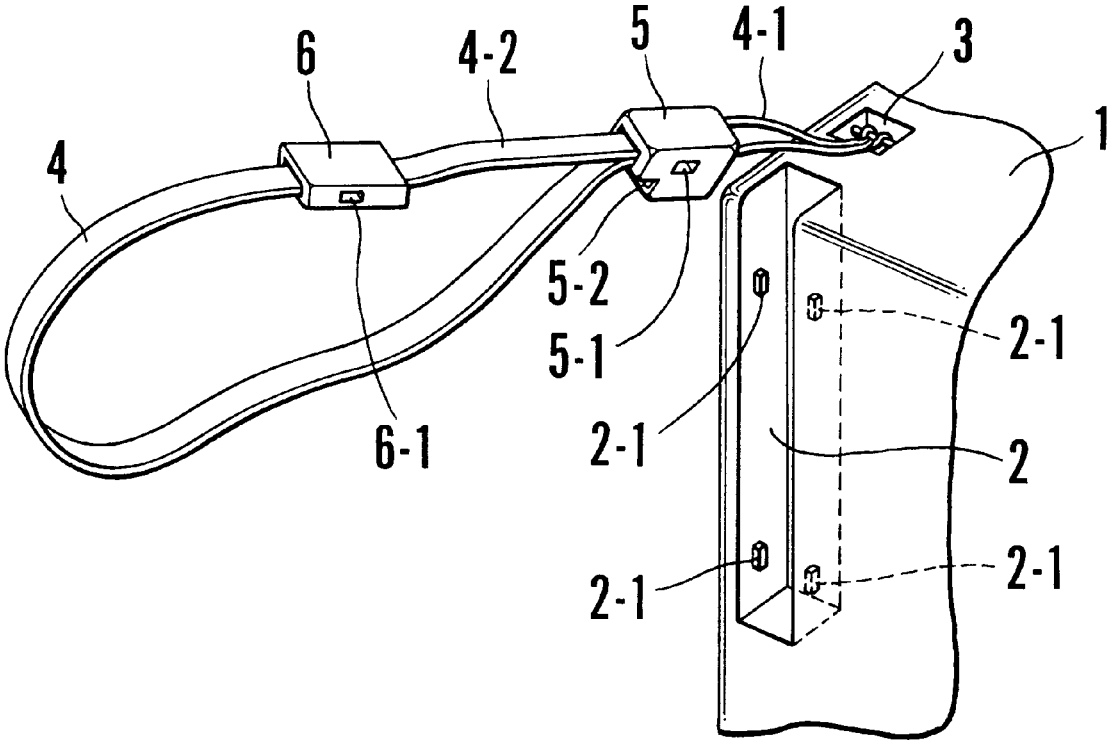
FIG. 3 is a perspective view showing a hand strap storage structure and a hand strap to be stored in it according to an example of the present invention.

FIG. 3 is a perspective view showing a hand strap storage structure and a hand strap to be stored in it according to one embodiment of the present invention.

As shown in FIG. 3, the hand strap storage structure of the present invention is constituted by a groove-like hand strap storage portion 2 formed in a terminal device main body 1, and a hand strap 4. Four projections 2-1 are formed on the two side wall surfaces of the hand strap storage portion 2. A hand strap mounting portion 3 is further formed in the terminal device main body 1.

Figure 4A:
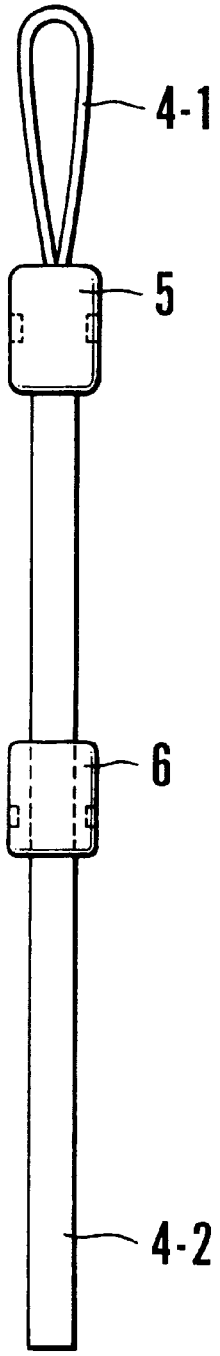
FIGS. 4A and 4B are plan and side views, respectively, showing the hand strap to be stored in the hand strap storage structure of the present invention.
Figure 4B:
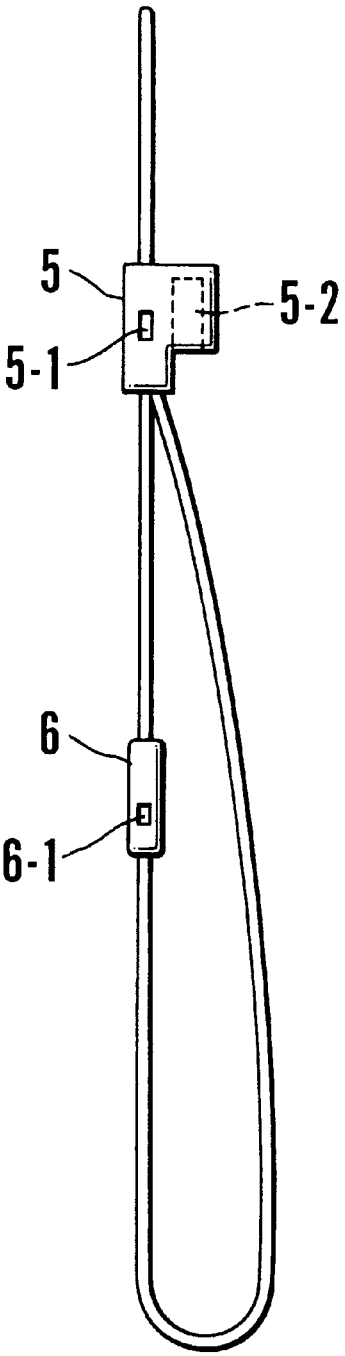

FIGS. 4A and 4B are plan and side views, respectively, showing the hand strap of the present invention.

A thin string loop 4-1 and thick string loop 4-2 of the hand strap 4 may be a continuous single string, or may be a plurality of strings connected to each other. In the embodiment described herein, the hand strap 4 is formed by connecting the thin string loop 4-1 and thick string loop 4-2.

The hand strap 4 has an overall length of about 400 mm if it is employed for a cellular telephone having an entire length of 120 mm to 130 mm. The two ends of the hand strap 4 are held together to form a loop. Accordingly, the hand strap 4 has a length of about 200 mm when it is stretched in the loop state. The thin string loop 4-1 has a length of 30 mm to 40 mm when it is stretched in the loop state, and the thick string loop 4-2 has a length of 160 mm to 170 mm when it is stretched in the loop state. Although a nylon fiber is mainly used as the material of the hand strap, the material of the hand strap is not limited to this.

Two caulking portions, i.e., a first caulking portion 5 and a second caulking portion 6, are attached to the hand strap 4 to be separate from each other in the longitudinal direction. Although these caulking portions are made of hard nylon, their material is not limited to this.

One side of the thin string loop 4-1 is inserted in the hand strap mounting portion 3 of the terminal device main body 1 to be engaged in it. As shown in FIGS. 4A and 4B, the other side of the thin string loop 4-1 is connected by caulking to the first caulking portion 5 near the hand strap mounting portion 3. The two ends of the thick string loop 4-2 are connected to the terminal device main body 1 by caulking so that the thick string loop 4-2 forms a ring. The thick string loop 4-2 is caulked to the second caulking portion 6. The second caulking portion 6 is mounted at a distance of about ¼ the entire length of the thick string loop 4-2 from the first caulking portion 5 (see FIGS. 3 and 6A).

Recesses 5-1 to engage with the corresponding projections 2-1 formed in the hand strap storage portion 2 of the terminal device main body 1 are formed in the two side surfaces of the first caulking portion 5. A recess 5-2 for inserting a folded end portion 9 of the thick string loop 4-2 therein, when storing the hand strap 4, is formed in the outer surface (end face in this embodiment) of the first caulking portion 5. Recesses 6-1 to engage with the corresponding projections 2-1 formed in the hand strap storage portion 2 are formed in the two side surfaces of the second caulking portion 6.

An operation performed for storing the hand strap of this embodiment having the above arrangement will be described.

Figure 5A:
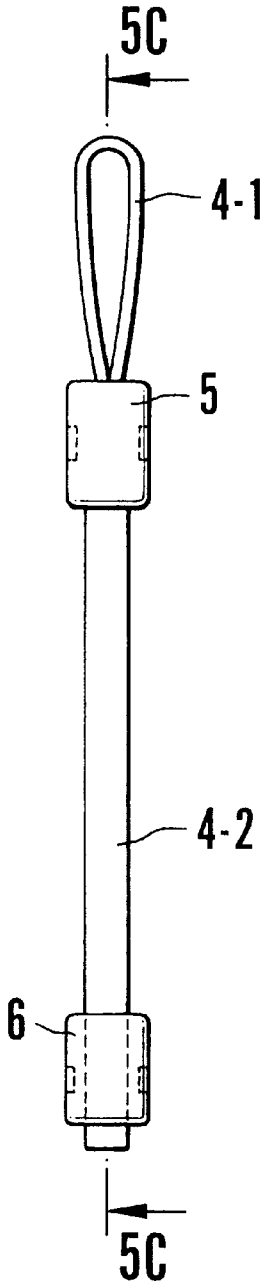
FIGS. 5A and 5B are plan and side views, respectively, showing the folded storage state of the hand strap which is to be stored in the hand strap storage structure of the present invention.
Figure 5B:
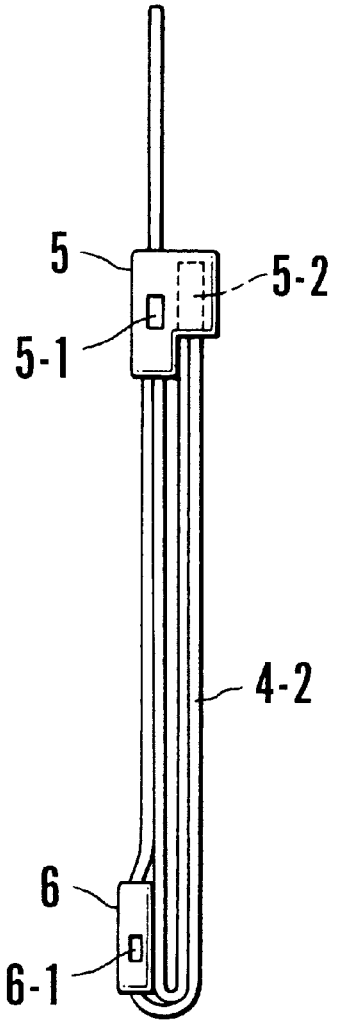
Figure 5C:
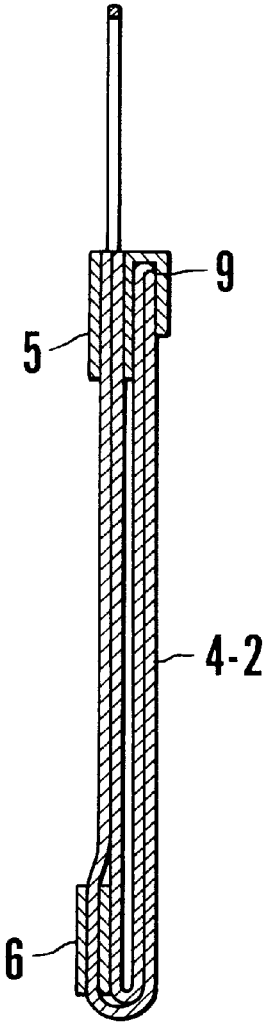
FIG. 5C is a sectional view taken along the line 5C—5C of FIG. 5A.

FIGS. 5A and 5B are plan and side views, respectively, showing the folding storage state of the hand strap which is to be stored in the hand strap storage structure of the present invention, and FIG. 5C is a sectional view taken along the line 5C—5C of FIG. 5A.

Figure 6A:
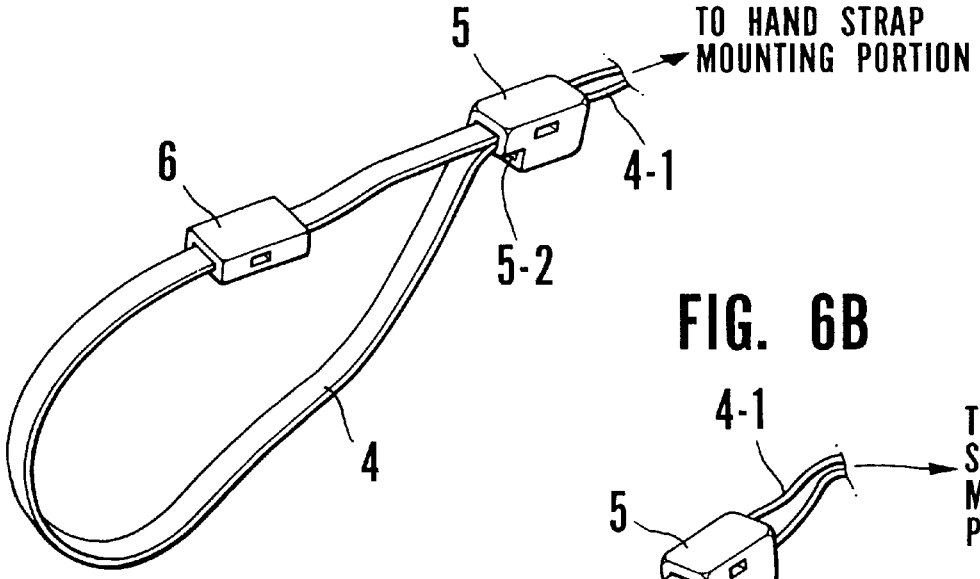
Figure 6B:
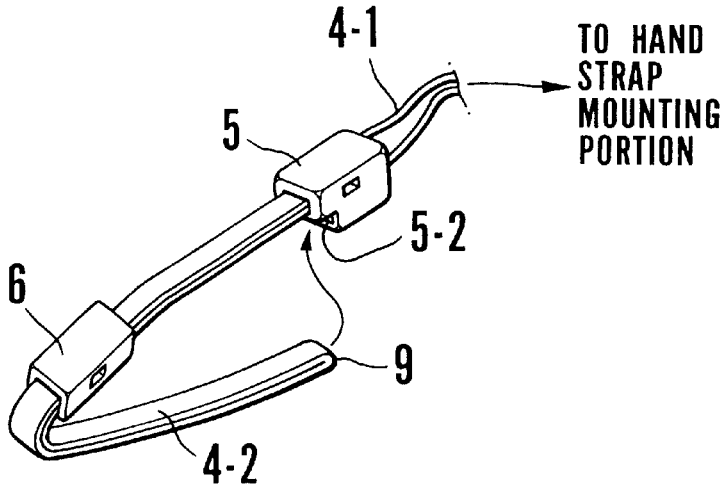
Figure 6C:
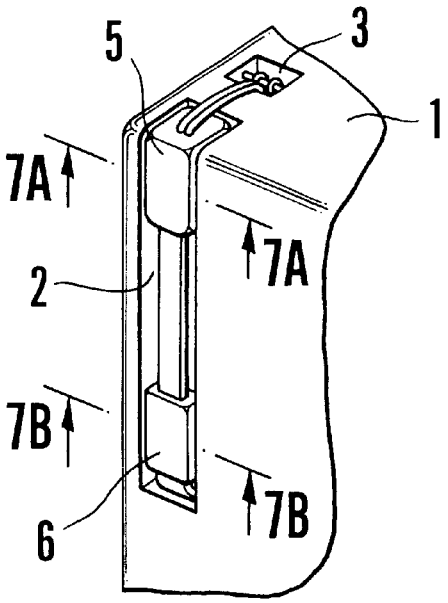

FIGS. 6A to 6C are perspective views showing an operation performed for storing the hand strap which is to be stored in the hand strap storage structure of the present invention, in which FIG. 6A shows a state wherein the hand strap is mounted on a hand strap mounting portion, FIG. 6B shows a state during folding, and FIG. 6C shows a state wherein the hand strap is stored and fixed in the hand strap storage portion.

Figure 7A:
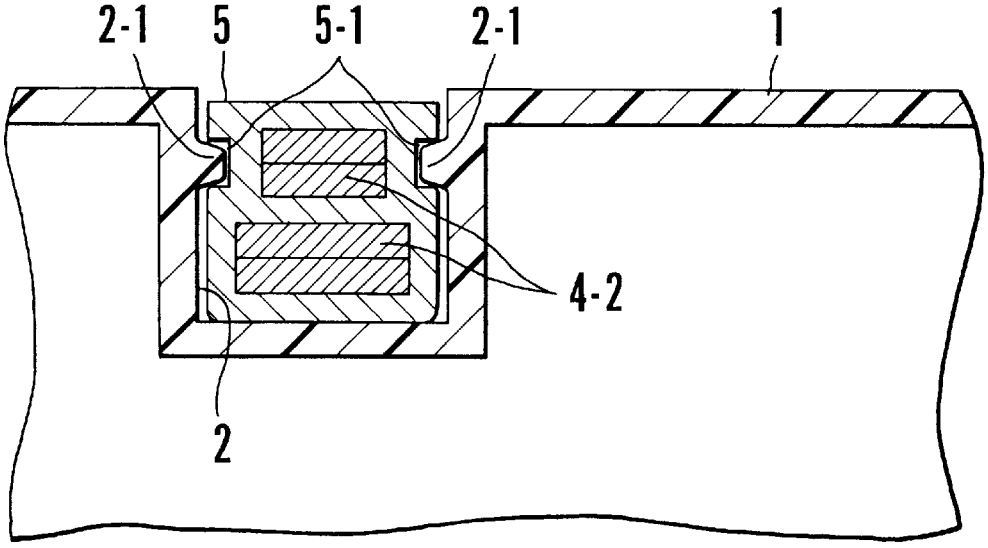
Figure 7B:
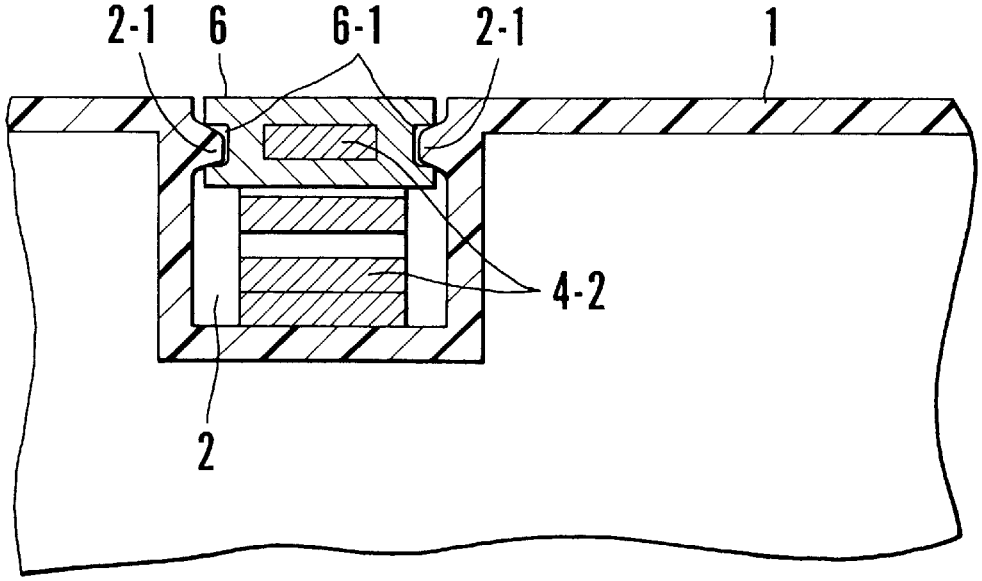

FIGS. 7A and 7B are sectional views showing a state wherein the hand strap is stored in a terminal device main body, in which FIG. 7A is a sectional view taken along the line 7A—7A of FIG. 6C, and FIG. 7B is a sectional view taken along the line 7B—7B of FIG. 6C.

FIG. 6A shows the hand strap 4 mounted by inserting its thin string loop 4-1 in the hand strap mounting portion 3.

The thick string loop 4-2 extending from the first caulking portion 5 is united to form two layers, as shown in FIG. 6B. At this time, the proximal end of the united two-layer thick string loop 4-2 is called the folded end portion 9. The two-layer thick string loop 4-2 is folded into four layers at the outlet position of the second caulking portion 6 (at this time, the length of the hand strap 4 becomes about ¼ the entire length, i.e., ½ the length of the fold-back state). This thick string loop 4-2 is set to extend along the second caulking portion 6, and the folded end portion 9 is pressed into the recess 5-2 formed in the end face of the first caulking portion 5. FIGS. 6A to 6C sequentially show the folding step, folding-back step, and pressing step. The hand strap 4 in the folded state, i.e., in the storage state, forms a rigid rod having a length about ¼ the entire length (½ its length in the fold-back state), and can accordingly be easily stored in the hand strap storage portion 2 of the terminal device main body 1. When the hand strap 4 is stored in the hand strap storage portion 2, the recesses 5-1 in the two side surfaces of the first caulking portion 5 engage with the corresponding projections 2-1 formed in the hand strap storage portion 2, and the recesses 6-1 in the two side surfaces of the second caulking portion 6 engage with the corresponding projections 2-1 formed in the hand strap storage portion 2. The distance between the upper and lower projections 2-1 of the hand strap storage portion 2 and the distance between the recesses 5-1 of the first caulking portion 5 and the recesses 6-1 of the second caulking portion 6 are equal to each other. Note that when extracting the hand strap 4 from the storage state, the operation described above may be performed in the reverse manner.

Figure 8A:
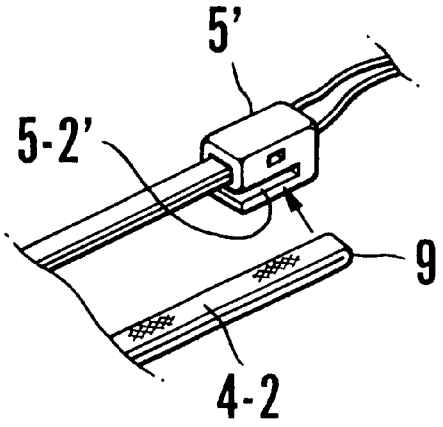
FIGS. 8A and 8B are perspective views showing an improvement of the hand strap storage structure of the present invention.
Figure 8B:
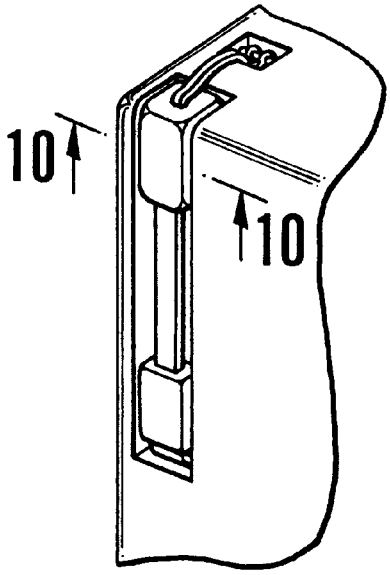
Figure 9A:
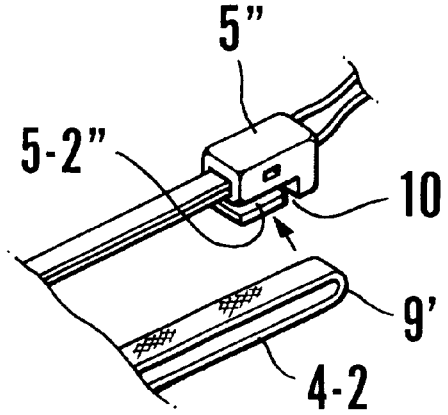
FIGS. 9A and 9B are perspective views showing another improvement of the hand strap storage structure of the present invention.
Figure 9B:
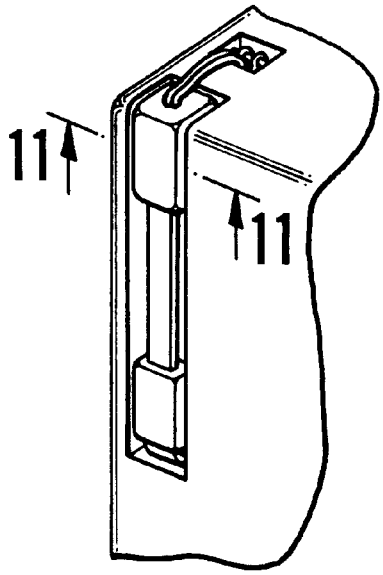
Figure 10:
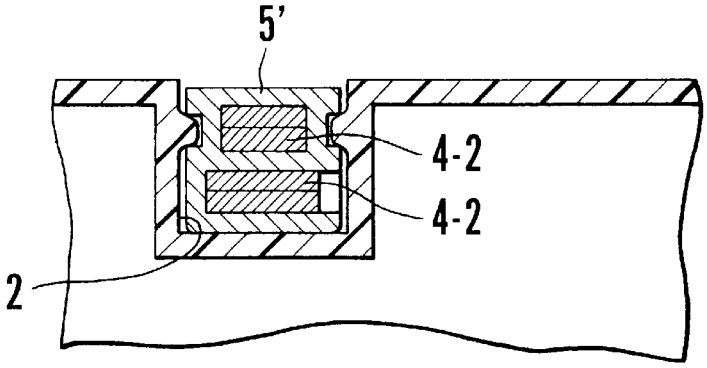
FIGS. 10 and 11 are sectional views taken along the lines 10—10 and 11—11 of FIGS. 8B and 9B, respectively.
Figure 11:
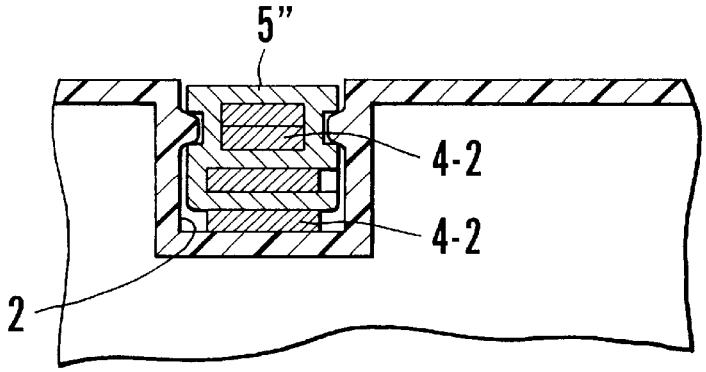

FIGS. 8A and 8B, and FIGS. 9A and 9B are perspective views showing two improvements of the hand strap storage structure of the present invention, in which each of FIGS. 8A and 9A show a fixing portion for the folded end of the hand strap 4 of the corresponding improvement, and each of FIGS. 8B and 9B shows the hand strap 4 stored and fixed in the hand strap storage portion 2 in the two improvements. FIGS. 10 and 11 are sectional views taken along the lines 10—10 and 11—11 of FIGS. 8B and 9B, respectively.

In FIG. 8A, a recess 5-2' is formed to extend across the two surfaces, i.e., the end face and a side surface, of a first caulking portion 5', and a folded end portion 9 of a thick string loop 4-2 of a hand strap 4 is pressed into the recess 5-2'. In FIG. 9A, a recess 5-2" is formed to extend across the two surfaces, e.g., the end face and one side surfaces, of a first caulking portion 5". A groove 10 is formed in the inner surface of the recess 5-2", and a folded end portion 9 of a thick string loop 4-2 of a hand strap 4 is hung by the recess 5-2. A preparation for storing the hand strap 4 is complete in this manner.

Figure 12:
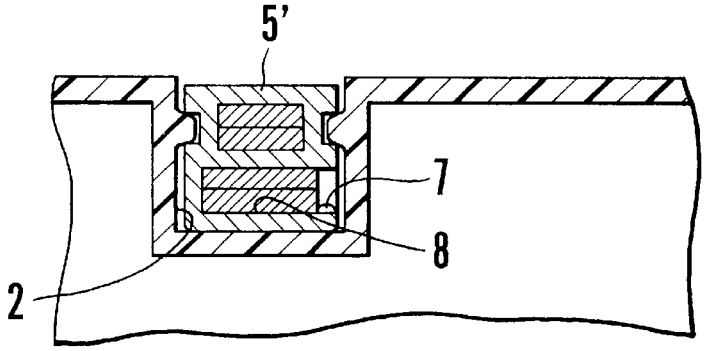
FIGS. 12 and 13 are sectional views showing still other improvements of the hand strap storage structure of the present invention shown in FIGS. 10 and 11, respectively.
Figure 13:
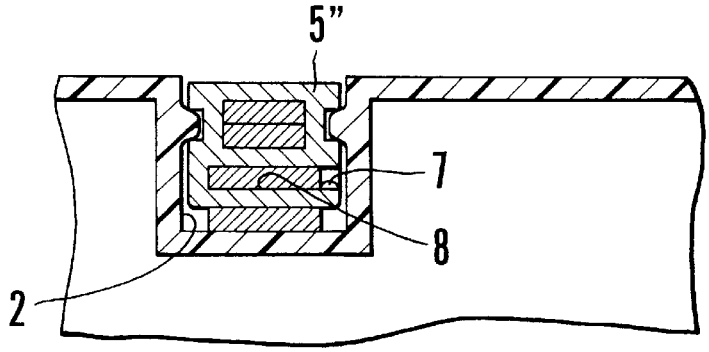

FIGS. 12 and 13 are sectional views respectively showing further improvements of the hand strap storage structures of the present invention shown in FIG. 10 and 11, respectively.

In each of the further improvements, a stopper 7 with which a thick string loop 4-2 of a hand strap 4 comes into contact is formed on a hand strap contact surface 8 formed in a recess 5-2 of a first caulking portion 5. This aims at preventing the hand strap 4 from disengaging from the recess 5-2.

When the thick string loop 4-2 is pulled before the hand strap 4 is stored in a hand strap storage portion 2, the stopper 7 prevents the thick string loop 4-2 from easily projecting or disengaging from the recess 5-2 of a first caulking portion 5. In this manner, the hand strap 4 can be easily, reliably stored in the hand strap storage portion 2. Although the stopper 7 is hemispherical in this embodiment, it can be formed into an elliptic shape or other shapes, and the number of stoppers to be formed is not limited.

According to the hand strap storage structure of the present invention described above, the hand strap 4 can be easily, reliably stored with a comparatively simple arrangement of forming the hand strap storage portion 2 in the terminal device main body 1 and forming two caulking portions on the hand strap 4. Therefore, even when the user carries the terminal device main body 1 by using a carrying means other than the hand strap 4 (e.g., the inner pocket of a bag or jacket), the hand strap 4 will not be caught by his finger or arm, or contents in the bag. A portable terminal device which is easy to use and can be handled easily can be provided.

What is claimed is:

1. A hand strap storage structure for storing a thick string loop of a hand strap in a terminal device main body having a hand strap mounting portion and a hand strap storage portion, said hand strap being constituted by a thin string loop and said thick string loop, and said thin string loop having a distal end engaged by said hand strap mounting portion, comprising (a) a first caulking portion and a second caulking portion provided to said hand strap to be separate from each other, (b) a plurality of recesses formed in two side surfaces of each of said first and second caulking portions, (c) a plurality of projections formed on two side wall surfaces of said hand strap storage portion to respectively engage with said plurality of recesses, and (d) folded end portion fixing means, formed on said first caulking portion, for detachably fixing a folded end portion formed on a proximal end of said thick string loop when storing said hand strap.

2. A structure according to claim 1, wherein said first caulking portion is caulked to said hand strap near said hand strap storage portion of said terminal device main body.

3. A structure according to claim 1, wherein said first caulking portion is caulked so as to connect a proximal end of said thin string loop and a distal end of said thick string loop of said hand strap.

4. A structure according to claim 1, wherein said folded end portion fixing means is a recess formed in one end face of said first caulking portion.

5. A structure according to claim 1, wherein said folded end portion fixing means is a recess formed to extend across two surfaces consisting of one end face and one side surface of said first caulking portion.

6. A structure according to claim 5, wherein said recess formed in said first caulking portion and serving as said folded end portion fixing means is formed with a groove for hooking said hand strap.

7. A structure according to claim 4, wherein said recess formed in said first caulking portion and serving as said folded end portion fixing means is formed with a stopper for preventing said hand strap from disengaging when said folded end portion of said hand strap is inserted in said recess.

8. A structure according to claim 5, wherein said recess formed in said first caulking portion and serving as said folded end portion fixing means is formed with a stopper for preventing said hand strap from disengaging when said folded end portion of said hand strap is inserted in said recess.

9. A structure according to claim 1, wherein a distance between said recesses formed in said two side surfaces of each of said first and second caulking portions is equal to a distance between said plurality of projections formed on said side wall surfaces of said hand strap storage portion.

10. A terminal device main body having a hand strap mounting portion and a hand strap storage portion and serving to engage a distal end of a thin string loop of a hand strap by said hand strap mounting portion, comprising (a) a first caulking portion for connecting a proximal end of said thin string loop and a distal end of a thick string loop of said hand strap to each other, (b) a second caulking portion provided on said thick string loop to be separate from said first caulking portion by a predetermined distance, (c) a plurality of recesses formed in two side surfaces of each of said first and second caulking portions, (d) a plurality of projections formed on two side surfaces of said hand strap storage portion to respectively engage with said plurality of recesses, and (e) folded end portion fixing means, formed on said first caulking portion, for detachably fixing a folded end portion formed on a proximal end of said thick string loop when storing said hand strap.

11. A main body according to claim 10, wherein said first caulking portion caulked so as to connect said proximal end of said thin string loop and said distal end of said thick string loop, respectively, of said hand strap.

12. A main body according to claim 10, wherein said folded end portion fixing means is a recess formed in one end face of said first caulking portion.

13. A main body according to claim 10, wherein said folded end portion fixing means is a recess formed to extend across two surfaces consisting of one end face and one side surface of said first caulking portion.

14. A main body according to claim 13, wherein said recess formed in said first caulking portion and serving as said folded end portion fixing means is formed with a groove for hooking said hand strap.

15. A main body according to claim 12, wherein said recess formed in said first caulking portion and serving as said folded end portion fixing means is formed with a stopper for preventing said hand strap from disengaging when said folded end portion of said hand strap is inserted in said recess.

16. A main body according to claim 13, wherein said recess formed in said first caulking portion and serving as said folded end portion fixing means is formed with a stopper for preventing said hand strap from disengaging when said folded end portion of said hand strap is inserted in said recess.

17. A main body according to claim 10, wherein a distance between said recesses formed in said two side surfaces of each of said first and second caulking portions is equal to a distance between said plurality of projections formed on said side wall surfaces of said hand strap storage portion.

* * * * *